US011618152B2

(12) United States Patent
Gauthier et al.

(10) Patent No.: US 11,618,152 B2
(45) Date of Patent: Apr. 4, 2023

(54) SHAFT SECURING MECHANISM FOR A TOOL

(71) Applicant: Gauthier Biomedical, Inc., Grafton, WI (US)

(72) Inventors: Michael T. Gauthier, Grafton, WI (US); Raymond Wollner, Kewaskum, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 379 days.

(21) Appl. No.: 16/773,391

(22) Filed: Jan. 27, 2020

(65) Prior Publication Data

US 2020/0238500 A1 Jul. 30, 2020

Related U.S. Application Data

(60) Provisional application No. 62/940,413, filed on Nov. 26, 2019, provisional application No. 62/796,672, filed on Jan. 25, 2019.

(51) Int. Cl.
*B25G 3/22* (2006.01)

(52) U.S. Cl.
CPC ..... *B25G 3/22* (2013.01)

(58) Field of Classification Search
CPC ..... B25G 3/22
See application file for complete search history.

(56) References Cited

U.S. PATENT DOCUMENTS 1,653,762 A * 12/1927 Fegley ..... B25G 3/22 279/82
6,453,804 B1 * 9/2002 Lee ..... A23L 3/001 62/331
7,287,449 B2 * 10/2007 Abel ..... B25B 23/0042 81/177.2
7,913,594 B2 * 3/2011 Gauthier ..... B25B 13/463 81/467
8,468,914 B2 * 6/2013 Gauthier ..... B25B 17/02 81/60
9,027,219 B2 * 5/2015 Gauthier ..... B25G 3/22 81/177.85
2012/0103144 A1 * 5/2012 Gauthier ..... B23B 31/22 81/177.85
2013/0214496 A1 * 8/2013 Lin ..... B25G 3/22 279/46.7

OTHER PUBLICATIONS

PCT/US2020/015198, International Preliminary Report on Patentability dated Jul. 27, 2021, 7 pages.

* cited by examiner

*Primary Examiner* — Emily M Morgan
(74) *Attorney, Agent, or Firm* — Boyle Fredrickson, S.C.

(57) ABSTRACT

A securing mechanism is provided for a tool that allows for the attachment and release of the shafts of a variety of implements from the tool. The mechanism has a construction that provides an easily releasable, but secure engagement of the implement shaft within the mechanism while also having an alignment feature which engages the implement at multiple locations when engaged with the mechanism to maintain the alignment and concentricity of the implement shaft with regard to the mechanism and the tool when in use.

14 Claims, 10 Drawing Sheets

SHAFT SECURING MECHANISM FOR A TOOL

CROSS-REFERENCE TO RELATED APPLICATIONS

This application claims priority from U.S. Provisional Application Ser. No. 62/796,672, filed on Jan. 25, 2019, and from U.S. Provisional Application Ser. No. 62/940,413, filed on Nov. 26, 2019, the both of which is expressly incorporated herein by reference in their entirety for all purposes.

FIELD OF THE DISCLOSURE

The present invention relates to hand tools, and more specifically to a mechanism for releasably securing various implements and shafts to a hand tool.

BACKGROUND OF THE DISCLOSURE

Hand tools are designed for a variety of uses to enable individuals to perform various tasks. These tools include handles that can be grasped by the individual in order to more securely operate the tool.

A number of tools of this type include various mechanisms that enable the tool to have a number of different implements having an attachment shaft releasably attached to the tool. These mechanisms enable the shaft of the implement to be attached to the tool and utilized therewith in an interchangeable manner, allowing a single tool with multiple removable attachments to provide various functions for the tool.

However, one of the prevalent drawbacks with mechanisms of this type is that the mechanism is unable to attach the implement shaft to the tool in a manner that prevents the implement from being or becoming misaligned with regard to the tool during use of the tool and implement, such that it is often necessary to remove and re-attach the implement to the tool in order to reposition the implement in proper alignment with the tool.

In addition, another prevalent drawback with mechanisms of this type is that the connection between the shaft of the implement and the tool is not fully rigid, such that an amount of movement, toggle or play between the handle and the implement is perceived by the user. This could lead to an error during use or a degraded perception of quality or confidence in the performance of the tool.

An improvement to mechanism of this type is found in U.S. Pat. No. 9,027,219, entitled Shift Securing Mechanism For A Tool, the entirety of which is expressly incorporated herein by reference for all purposes. However, while addressing certain shortcomings of prior art mechanisms, improvements are still available to the shaft securing mechanism.

Therefore, it is desirable to develop a securing mechanism for a tool that can be easily operated to secure and release various interchangeable implements from the tool while maintaining the alignment of the shaft of the implement with regard to the tool when the implement is secured to the tool utilizing the mechanism and in use.

Furthermore, it is desirable to develop a securing mechanism for a tool that has a fully rigid connection between the shaft of the implement and the tool, eliminating any actual or perceived toggle or play between the implement and the handle.

SUMMARY OF THE DISCLOSURE

According to a one aspect of an exemplary embodiment of the present disclosure, a securing mechanism is provided for a tool that allows for the attachment and release of the shafts of a variety of implements from the tool. The securing mechanism is applicable to application in hand held and/or operated surgical instruments and in "navigated surgical instruments," such as instruments that are attached to a surgical navigation system and require absolute precision so the computer knows where the tip of an instrument is during surgery. This securing mechanism for a tool of the present disclosure has a number improvements to prior shaft securing mechanisms. One improvement is the elimination of the side to side toggle present in all existing connectors. The mechanism has a construction that provides a secure engagement of the implement shaft within the mechanism to substantially reduce any slop, toggle or play in the engagement of the implement and tool. The reduction in toggle is achieved by two locking areas present within the mechanism and an increase in the spacing between them. Additionally, one of the locking areas provides for pinching of the shaft with point to line contact to push the shaft against the internal geometry of the mechanism.

According to another aspect of an exemplary embodiment of the present disclosure, the securing mechanism has an alignment feature which maintains the alignment of the implement shaft with regard to the mechanism and the tool, and results in increased concentricity of the implement with the tool. In one exemplary embodiment, the securing mechanism provides this attribute by utilizing two concentric locking tapers on the same component that engage and concentrically hold the shaft relative to the securing mechanism.

According to still another aspect of an exemplary embodiment of the present disclosure, the implement can be self-loaded without the need to disengage the mechanism, such as by depressing a collar. This functionality is achieved by utilizing multiple sets of ball bearings present in the mechanism that are moved up tapered surfaces when the shaft is inserted into the securing mechanism.

According to still a further aspect of an exemplary embodiment of the present disclosure, the shaft employed with the mechanism enables multiple points of contact between the shaft and the mechanism to enable a universal secure and aligned engagement between the shaft and the mechanism on preexisting shafts and on custom shaft configurations.

According to another aspect of an exemplary embodiment of the present disclosure, the mechanism has a relatively simple construction that enables the mechanism to be utilized with tools having various other mechanisms disposed therein without significantly affecting the operation or overall size of the tools.

Numerous other aspects, features, and advantages of the present invention will be made apparent from the following detailed description together with the drawing figures.

BRIEF DESCRIPTION OF THE DRAWINGS

The drawings illustrate the best mode currently contemplated of practicing the present invention.

In the drawings.

DETAILED DESCRIPTION OF THE DRAWINGS

Figure 1:
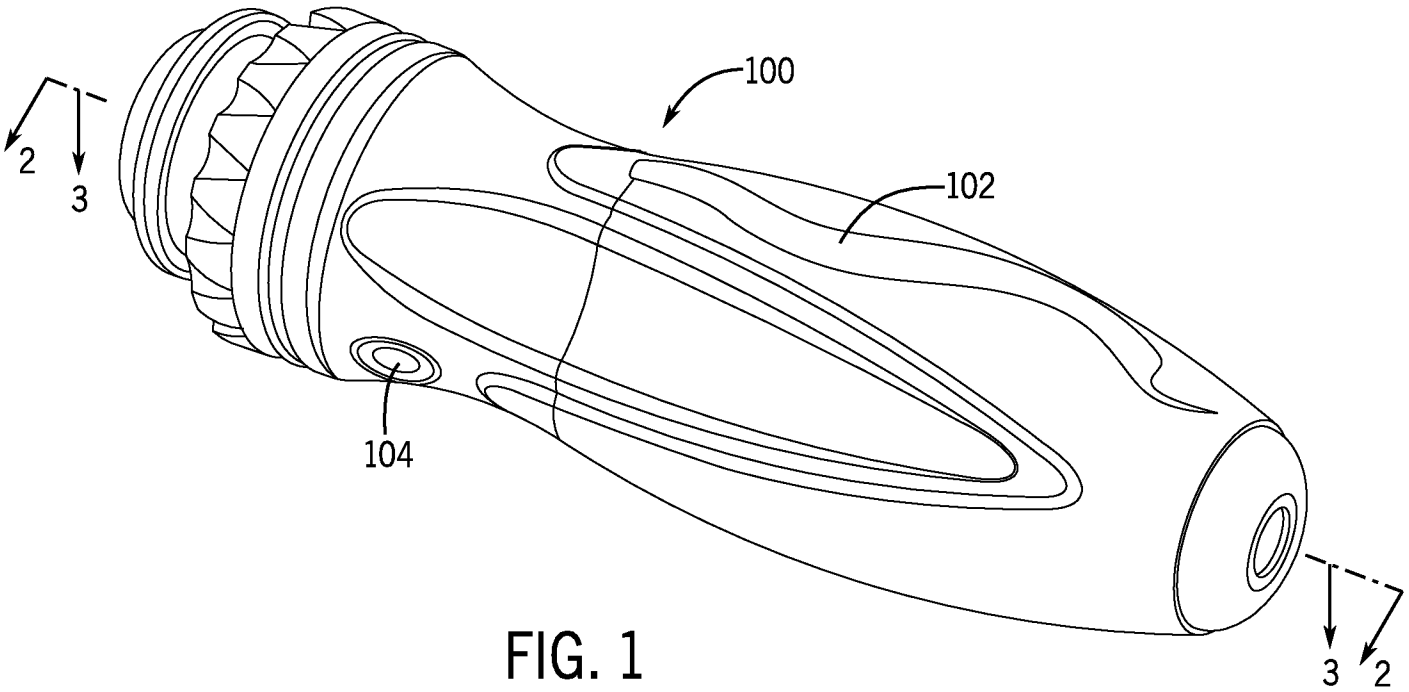
FIG. 1 is an isometric view of a tool including one embodiment of a securing mechanism constructed according to the present disclosure.

With reference now to the drawing figures in which like reference numerals designate like parts throughout the disclosure, a tool handle constructed according to the present invention is indicated generally at 100 in FIG. 1. The handle 100 can be formed in any shape to be utilized as a hand tool and is preferably ergonomically shaped with tactile features 102 to assist an individual in maintaining a secure grip on the handle 100. In addition to the features 102, the handle 100 can have other design elements 104 positioned thereon as desired. An example of such a handle is disclosed in Gauthier et al. U.S. Pat. No. 9,027,219, entitled Shaft Securing Mechanism For A Tool, the entirety of which is expressly incorporated herein by reference for all purposes.

Looking now at FIGS. 1-11, the handle 100 is formed with a securing mechanism 106 that is capable of releasably securing an implement shaft 108 to the handle 100. The shaft 108 can include any implement or feature (not shown) at the end of the shaft 108 not secured to the mechanism 106 in order to provide various functionalities to the handle 100.

In addition to the securing mechanism 106, the handle 100 can also include other mechanisms therein alone or in combination with one another, such as, for example, a torque limiting mechanism or a ratcheting mechanism, such as those shown and described in U.S. Pat. No. 7,913,594, entitled Ratcheting Torque Wrench, which is expressly incorporated herein by reference in its entirety. Also, the handle 100 can incorporate a variable gear ratio mechanism, such as that shown and described in U.S. Pat. No. 8,468,914, entitled Variable Gear Ratio Ratchet, which is expressly incorporated herein by reference in its entirety.

In the one embodiment illustrated in the drawing figures, the securing mechanism 106 is incorporated within a handle 100 also including a ratcheting mechanism 110. The details of the mechanism 110 are not discussed in detail, as they are disclosed in the '594 patent, mentioned previously and incorporated herein.

Figure 2:
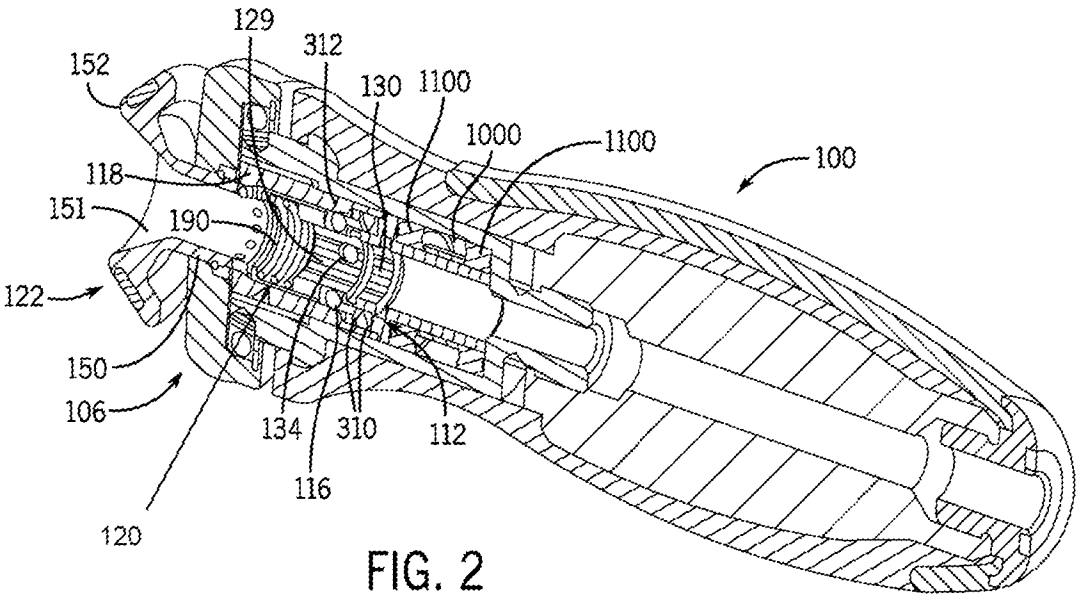
FIG. 2 is a cross-sectional view along line 2-2 of FIG. 1.
Figure 3:
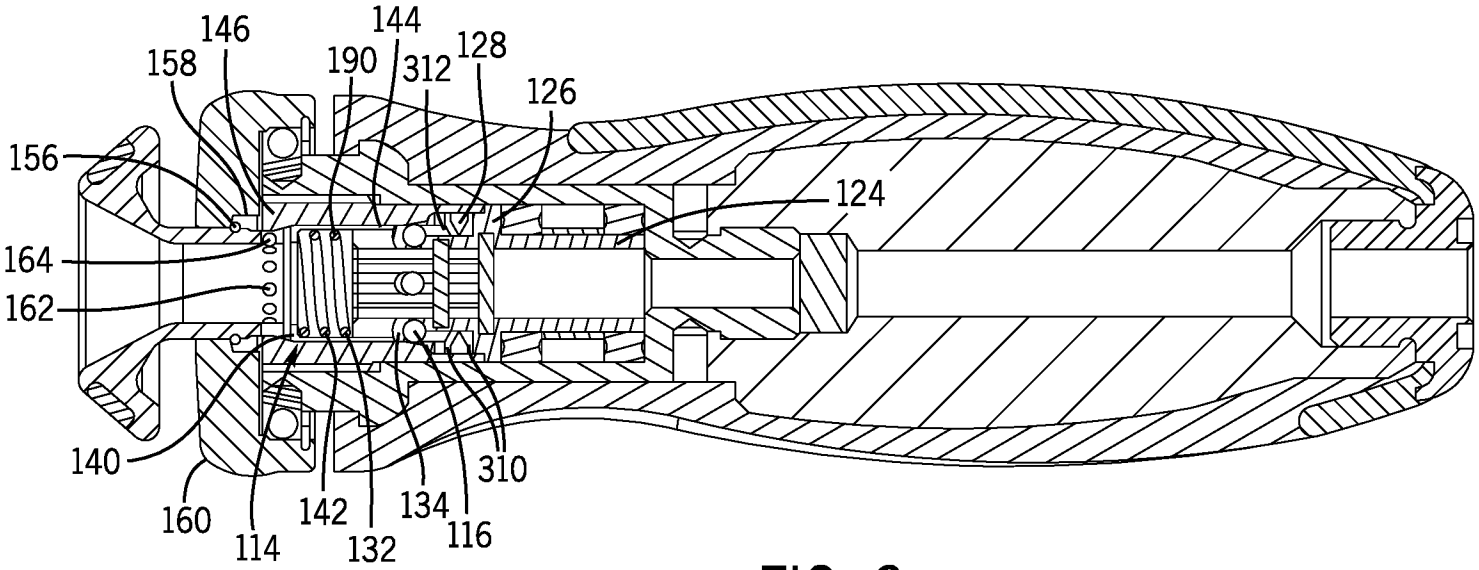
FIG. 3 is a cross-sectional view along line 3-3 of FIG. 1.

The securing mechanism 106 includes as component parts an engagement socket 112, a bushing 114, a number of ball bearings 116, a locking sleeve 118, a biasing spring 120, wave springs 310, positioning ring 312, and a release collar 122. The engagement socket 112, as best shown in FIGS. 2 and 3, is disposed within a cavity 1000 formed in the handle 100, and is held in alignment with the cavity 1000 by a number of bearings 1100 engaged between the socket 112 and the handle 100. The socket 112 is generally cylindrical in shape defining a central passage 129 therethrough and includes an inner section 124, a radial flange 126 at one end of the inner section 124, and an outer section 128 extending outwardly from the flange 126 opposite the inner section 124. On the interior surface of the socket 112 are disposed a number of axial grooves 130 on an interior surface of the socket 112 that extend the length of the socket 112 through the passage 129. The grooves 130 can be present in any number and can have any suitable cross-sectional shape, and are oriented around the interior of the socket 112 in a configuration that enables the grooves 130 to engage all of the corners of various geometric shapes present on a shaft 108, such as triangles, squares, or other polygonal shapes. In the illustrated exemplary embodiment, there are eight (8) grooves 130 located on the interior of the socket 112 in order to provide multiple four-point engagement configurations between the socket 112 and the shaft 108. Additionally, the grooves 130 can include an outwardly tapered end 132 to provides a self-aligning function to the grooves 130 to assist in achieving the proper alignment of the shaft 108 with the grooves 130, and may function as a stop with respect to the insertion of the shaft 108 into the socket 112 as the tapered groove ends 132 engage the shaft 108 when fully inserted into the socket 112. Further, the tapered ends of each groove 130 prevent the shaft 108 from binding within the socket 112 when the shaft 108 is subjected to external compressive forces acting axially on the shaft 108, such as pounding the handle 100 to drive an element engages with the shaft 108 opposite the handle 100 to a desired depth. The tapered ends 132 are formed complementary to faceted surfaces 304 on the shaft 108 to promote surface to surface contact when the shaft 108 is fully seated in the socket 112 to minimize bearing stresses.

The socket 112 also includes a number of openings 134 extending through the socket 112, and more specifically the outer section 128 between adjacent grooves 130, and within each of which is disposed a ball bearing 116, though the hearings 116 can have alternative shapes as well, such as pins, cylindrical rollers or wedges, among others. The openings 134 have a narrowed inner end 136 that prevents the bearings 116 from passing entirely into the interior of the socket 112. While any number of bearings 116 and openings 134 can be used, in the illustrated embodiment best shown in FIGS. 11 and 12, four (4) of each are present to provide a secure engagement of the shaft 108 with the bearings 116 and the socket 112 for any configuration of the shaft 108 as a result of the multiple points of engagement between the bearings 116 and the shaft 108. Additionally, in the illustrated embodiment, the bearings 116 and openings 134 are disposed in the socket 112 at locations between the grooves 130 so as to minimize the interference of the bearings 116 with the implement engaged within the grooves 130.

The bearings 116 are retained within the openings 134 from the exterior of the socket 112 in part by a bushing 114 disposed around the exterior of the socket 112, as best shown in FIG. 3. The bushing 114 is formed as a cylindrical sleeve having a diameter slightly larger than that of the socket 112, enabling the bushing 114 to slide with respect to the socket 112. The bushing 114 includes an inwardly extending radial flange 140 spaced from the socket 112 and defines an opening 142 therethrough in alignment with the central passage 129 of the socket 112. The radial flange 140 locates the bushing 114 at least partially over the openings 134 by its contact with the exterior of the socket 112, such that the bushing 114 partially obscures the openings 134 on the exterior surface of the socket 112 to retain the hearings 116 therein. Alternatively, the bushing 114 can be used in connection with or replaced by other suitable activation member(s) such as a push rod (not shown) that urges the bearings 116 into the openings 134.

The movement of the bushing 114 along the socket 112 is guided by a locking sleeve 118 that abuts, and in the illustrated embodiment is connected to, the flange 126 on the socket 112, as best shown in FIGS. 2 and 3. The locking sleeve 118 is generally cylindrical in shape and defines a central passage 144 that is aligned with the opening 142 in the bushing 114 and the central passage 129 of the socket 112. The passage 144 has an inwardly tapering outer end 146 located adjacent but spaced from the flange 140 of the bushing 114. Additionally, while the locking sleeve 118 can be formed with any desired configuration, in one embodiment, the sleeve 118 can include a number of teeth 148 on an exterior surface 149, such that the sleeve 118 can also function as the central gear in the ratcheting mechanism 110 disclosed in the '594 patent. The sleeve 118 is affixed to the flange 126 on the socket 112 in any suitable manner, such as by welding, for example, to hold the socket 112, bushing 114 and sleeve 118 in axial alignment with one another.

The bushing 114 is urged away from the socket 112 by a biasing member or spring 190 held in position between the outer end of socket 112 and the flange 140 of the bushing 114. The spring 190 biases or pushes the bushing 114 away from the socket 112 to enable the bearings 116 to a default engaged position within the socket 112. In addition, the spring 190 also presses a release collar 122 outwardly from the locking sleeve 118. The collar 122, as best shown in FIGS. 2 and 3, includes a cylindrical guide portion 150 and an outwardly extending engagement portion 152. The guide portion 150 is positioned in direct abutment with the flange 140 of the bushing 114 and defines a central passage 151 in alignment with the central passage 144 of the locking sleeve 118, the opening 142 in the bushing 114 and the central passage 129 of the socket 112, and has a diameter slightly less than that of the passage 144, enabling the guide portion 150 to be inserted into the passage 144. To retain the guide portion 150 within the passage 144, the guide portion 150 includes a peripheral notch 154 in which is disposed a retaining ring 156. The ring 156 extends outwardly from the guide portion 150 into a corresponding recess 158 in the handle 100, such as in an end cap 160 secured to the handle 100 over the locking sleeve 118 to retain the sleeve 118 and socket 112 within the cavity 1000 in the handle 100. The recess 158 has a width greater than that of the ring 156 to enable the ring 156 to move within the recess 158. The ring 156 is biased into engagement with the outer end of the recess 158 by the biasing member/spring 190.

Between the flange 140 and the ring 156, the guide portion 150 includes a number of apertures 162 spaced about the circumference of the guide portion 150 and within which are disposed ball bearings 164, though the bearings 164 can have alternative shapes as well, such as pins, cylindrical rollers or wedges, among others. The apertures 162 are formed similarly to the openings 134 in the socket 112 to receive and retain the bearings 164 therein. The size of the bearings 164 is such that when the apertures 162 and the bearings 164 are aligned with the larger diameter section of the passage 144 in the locking sleeve 118, the bearings 164 extend outwardly from the guide portion 150 into contact with the surface of the passage 144. As the biasing member 120 urges the collar 122 and guide portion 150 outwardly from the passage 144, the bearings 164 contact the inwardly tapering section of the passage 144 and are urged inwardly into the passage 151 through the apertures 162. In this position, the bearings 164 can engage the portion of the shaft 108 positioned within the passage 151.

As best shown in FIGS. 4-7, in the illustrated exemplary embodiment, the shaft 108 includes a first geometric portion 200 disposed at the end 202 of the shaft 108 and a second geometric portion 204 spaced axially from the first portion 200 opposite the end 202. The first portion 200 is generally square in cross-section with angled or curved corners 206 such that the first portion 200 can be readily oriented, aligned and engaged within the grooves 130 formed on the interior of the socket 112 and the associated bearings 116. The second portion 204 also is generally square in cross-section with angled or curved corners 208, but is slightly larger than the first portion 200, has a greater width or diameter. Each portion 200, 204 includes a number of flat surfaces or faces 304, 306 thereon that can have different sizes. However, in other embodiments the second portion 204 can have other cross-sectional shapes, such as circular or any other suitable profiles that are insertable within the passage 151 of the collar 122. The first portion 200 is joined to the second portion 204 by the faceted surfaces 133 to provide the stopping function for the insertion of the shaft 108 within the socket 112. In addition, the configuration of the second portion 204 enables some of the bearings 164 in the guide portion 150 to engage and secure the second portion 204 of the shaft 108 relative to the mechanism 110.

Figure 5:
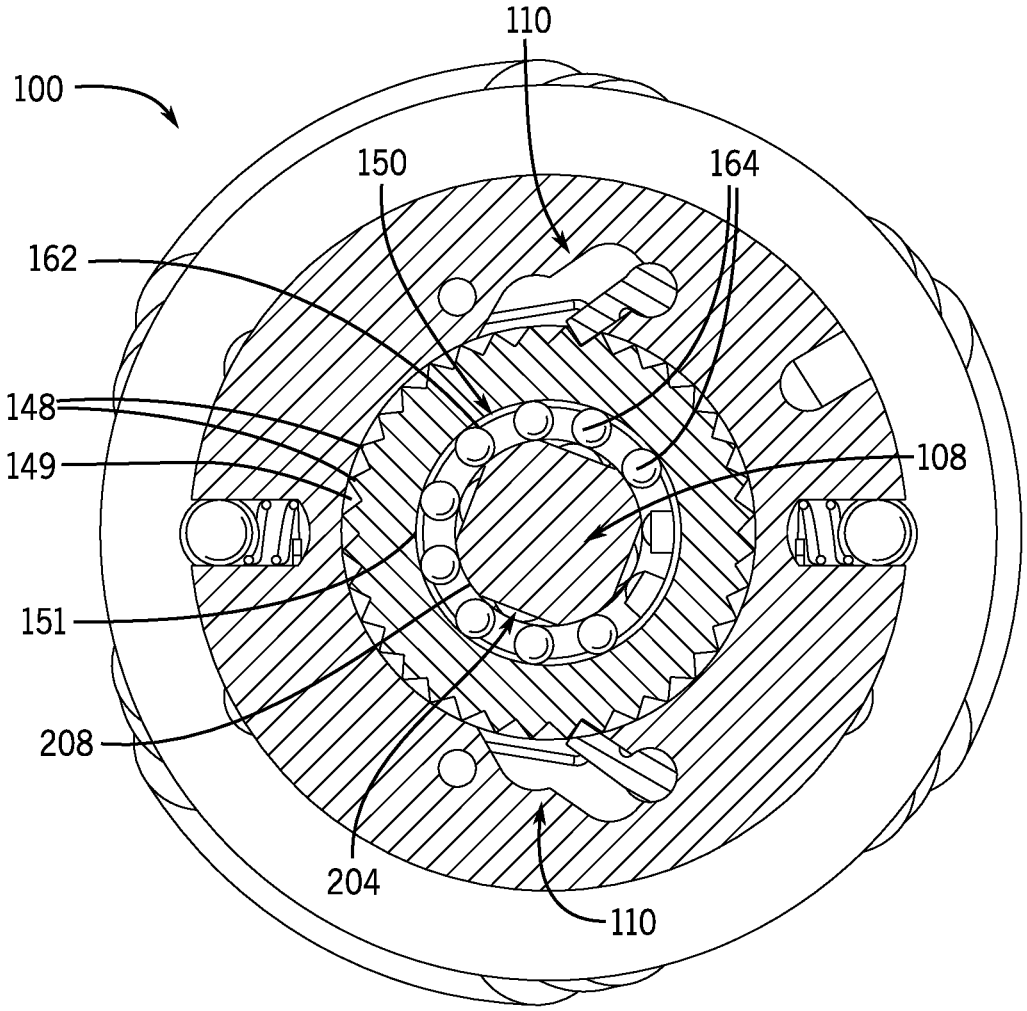
FIG. 5 is a cross-sectional view along line 5-5 of FIG. 4.
Figure 6:
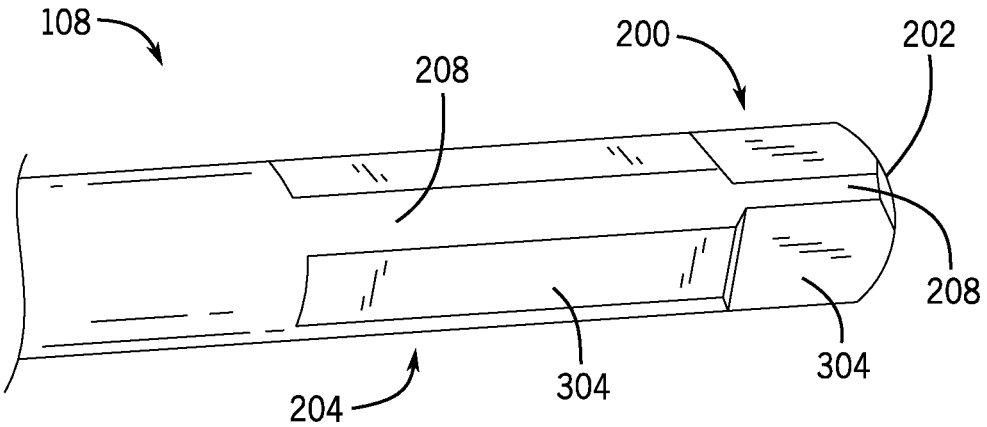
FIG. 6 is a partially broken away, isometric view of the shaft of FIG. 4.
Figure 7:
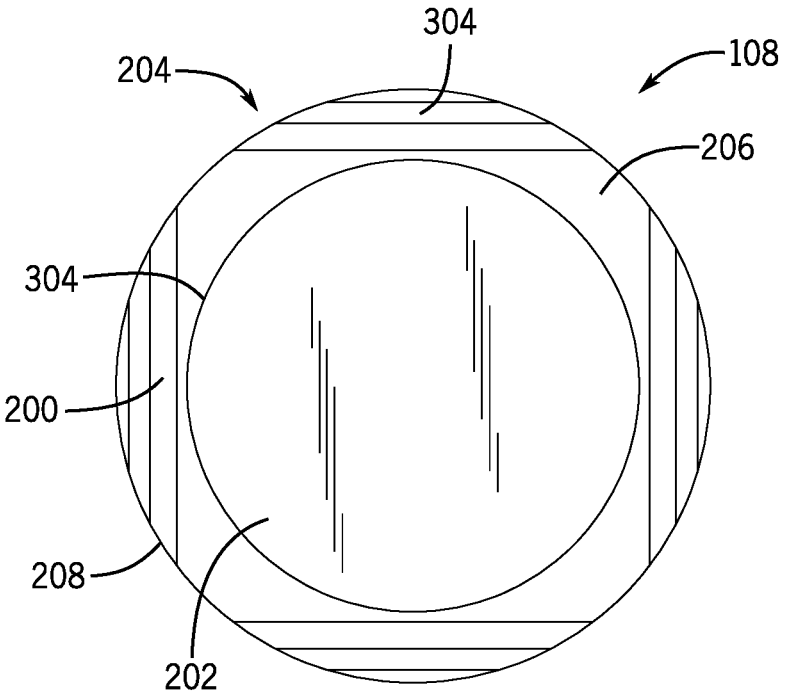
FIG. 7 is a front elevation view of the shaft of FIG. 4.
Figure 8:
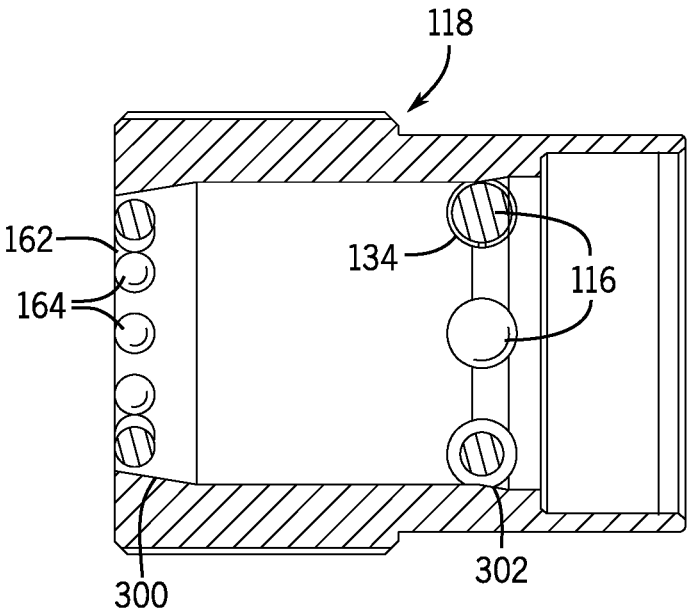
FIG. 8 is a cross-sectional view of a sleeve of the securing mechanism of FIG. 1.
Figure 9:
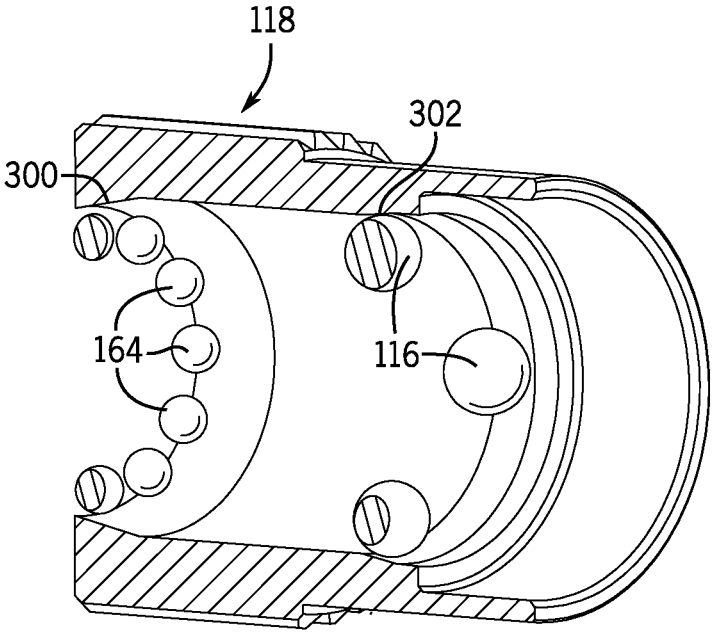
FIG. 9 is an isometric cross-sectional view of the sleeve of FIG. 8.

In the exemplary illustrated embodiment of FIG. 5, eleven (11) bearings 164 are present in the guide portion 150. When the second portion 204 of the shaft 108 is positioned within the guide portion 150 and the bearings 164 are urged into the passage 151 through the apertures 162, a subset of the bearings 164 will engage the second portion 204, with the remainder of the hearing 164 remaining out of contact with the second portion 204. In this configuration, the bearings 164 can universally engage both existing shafts and custom shafts having a variety of configurations for the second portion 204 and surface 306, with some hearings 164 engaging the second portion 204 of the shaft 108 and others remaining out of contact to enable the second portion 204 to be securely engaged by the bearings 164.

Referring now to FIGS. 3, 8-10 and 14, in order to enable the securing mechanism 106 to provide the significant reduction and/or elimination of the toggle or play between the shaft 108 and the mechanism 106, the sleeve 118 includes a first or front taper 300 and a second or rear taper 302. Each taper 300, 302 is concentric to the sleeve 118 and extends around the interior circumference of the sleeve 118 and is aligned with one of the sets of bearings 116, 164 respectively. The tapers 300 and 302 are spaced from one another on the sleeve 118 such that the sleeve 118 is a single part that enables the load applied to the shaft 108 to be transmitted to the sleeve 118 through both sets of bearings 116 and 164. As this load is transmitted to a single component, i.e., the sleeve 118, the alignment of the shaft 108 relative to the sleeve 118 and thus to the handle 100 is significantly improved, enhancing the ability of the mechanism 106 to hold the shaft 108 concentrically with regard to the handle 100 when in use.

In addition, as both sets of bearings 116 and 164 are engaged with the respective tapers 300, 302, when the shaft 108 is inserted within the collar 122, the shaft 108 can engage and urge the bearings 116 and 164 along the associated taper 300 or 302. As such, there is no need for the collar 122 to additionally be pressed inwardly to disengage the securing mechanism 106, simplifying the operation of the handle 100.

Figure 11:
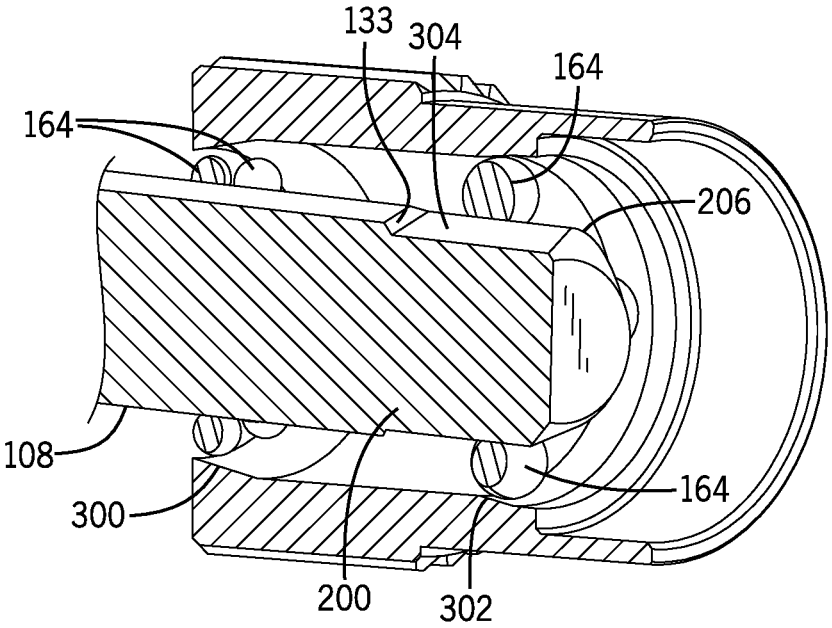
FIG. 11 is a cross-sectional view of a shaft engaged with the sleeve of FIG. 8.
Figure 12:
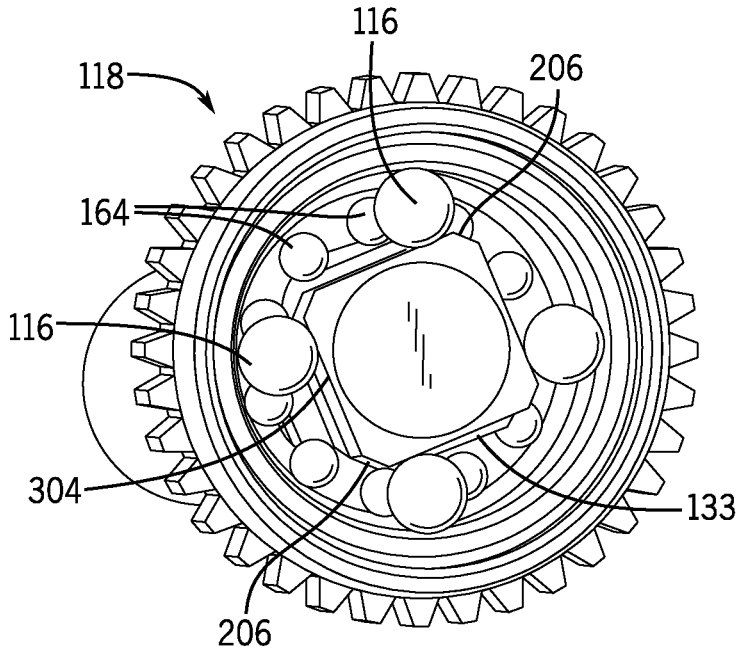
FIG. 12 is a front isometric view showing the securing mechanism of FIG. 10 engaged with a shaft.
Figure 13:
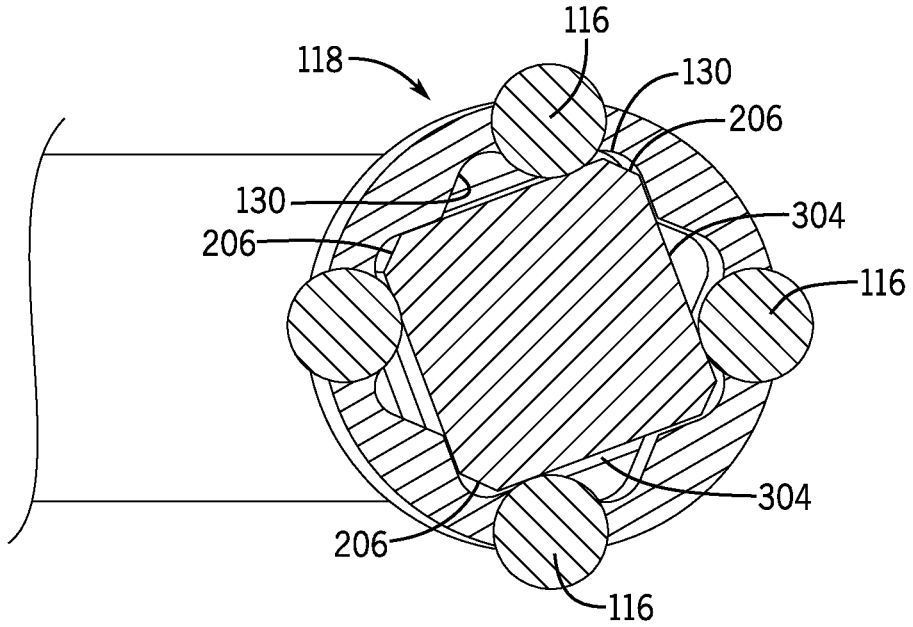
FIG. 13 is a front isometric view of a portion of the sleeve of FIG. 8 engaged with the shaft.

Referring now to FIGS. 11-13, when the shaft 108 is inserted within the mechanism 106, the bearings 116 and 164 engage the shaft 108, and in the illustrated exemplary embodiment, the first portion 200 and second portion 204 of the shaft 108. With the engagement of the bearings 116 and the first portion 200, the number of bearings 116 is selected to provide the desired number of points of contact between the bearings 116 and the first portion 200 of the shaft 108. In the illustrated exemplary embodiment, with eleven (11) bearings 116, the mechanism 106 provides sufficient points of contact between the mechanism 106 and the implement/shaft 108 to hold the implement 108 concentric to the handle 100, which is also good for shafts 108 that have additional flats or interruptions on the circumference of the shaft 108, such as the first portion 200 and the second portion 204.

With regard to the bearings 164, the position of these four (4) hearings 116 in the illustrated exemplary embodiment is selected to pinch the shaft 108 with point to line contact with the rear locking ball bearings 116. As best shown in FIG. 11-13, the bearings 116 engage each side 304 of the first portion 200 of the shaft 108 at a location offset from the midpoint of the side 304, thus "pinching" each corner 206 of the shaft 108 between the groove 130 and the bearing 1116. This orientation pushes the shaft 108 against internal the geometry of the sleeve 118, such that during use of the handle 100 and shaft 108, the force causes the shaft 108 to twist against the internal square geometry of the sleeve 118.

Figure 10:
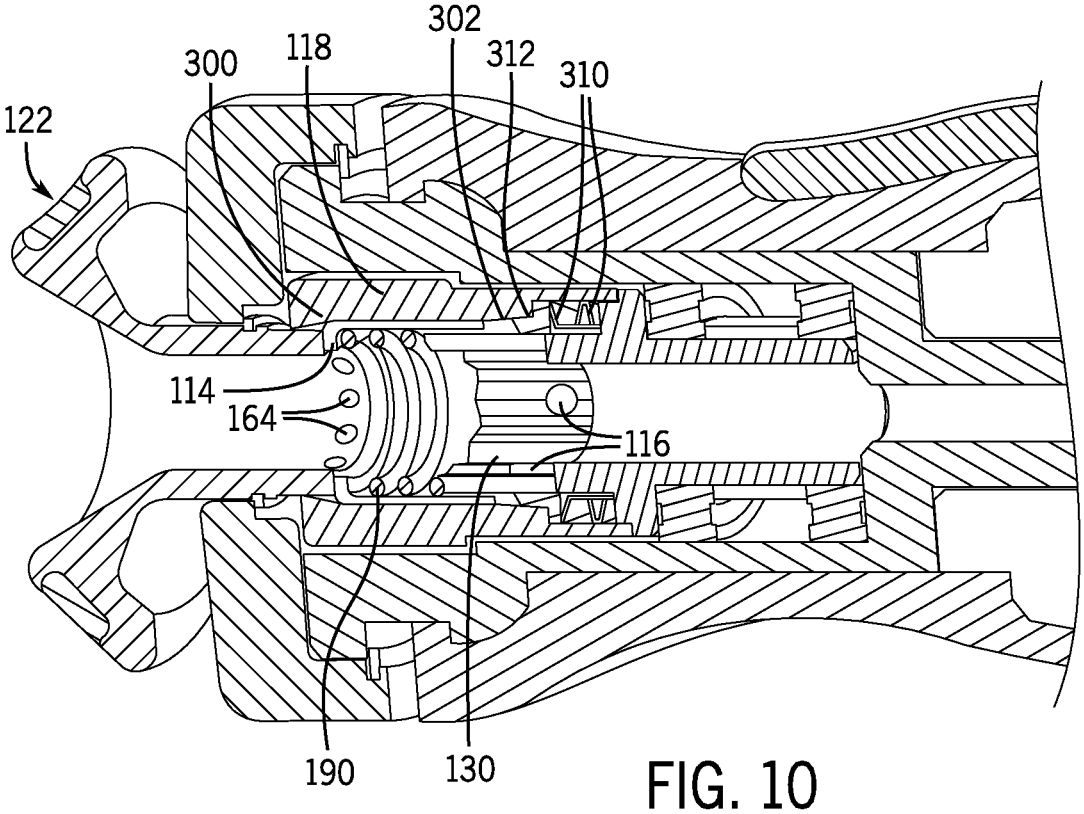
FIG. 10 is a partially broken away, cross-sectional view of the tool of FIG. 1.
Figure 14:
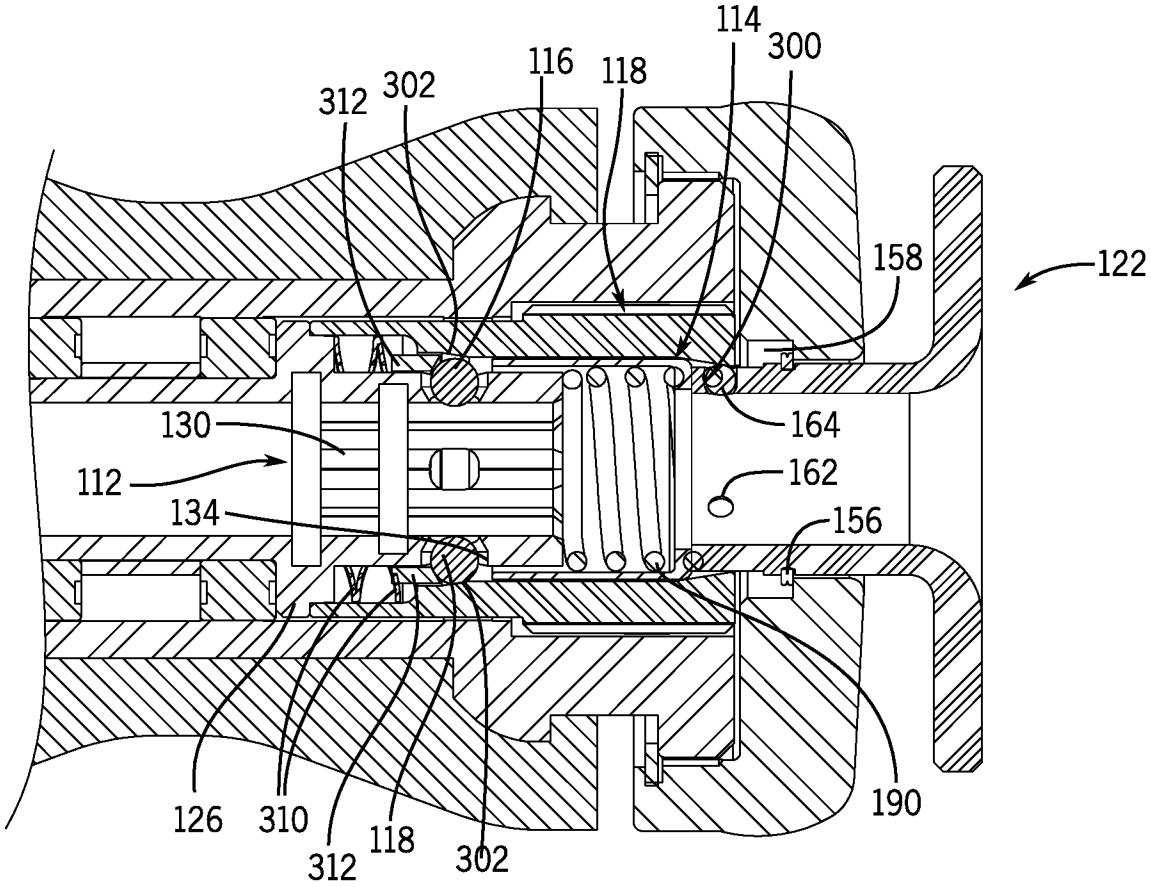
FIG. 14 is a partially broken away cross-sectional view of a second embodiment of the securing mechanism of the present invention.

To assist in compressing the mechanism 106 and bearings 116 against the shaft 108, in the illustrated exemplary embodiment of FIGS. 3, 10 and 14, two different biasing members 190 and 310, the compression spring 190 and wave springs 310, operate to push the balls against their respective tapered surfaces 300, 302 of the sleeve 118 and towards the aligned implement/shaft surface/portion 200, 204 to hold the implement/shaft 108 in place. If a tensile force is applied to try and remove the shaft 108, this results in both sets of balls 116 and 164 riding further up the associated taper 300, 302 and grabbing the implement/shaft 108 with increased radial force.

The release of each independent bearing set 116 and 164 is initially achieved by pressing on the outer release collar 122 for the bearing locking set 116. The presses the collar 122 inwardly against the bushing 114 and the compression spring 190 disposed within the bushing 114 to enable the bearings 116 to move outwardly away from the shaft 108 along the taper 300. The bushing 114 also contacts the bearings 164 opposite the collar 122 to push the bearings 164 down the taper 302 against the bias of the wave spring 310 and release the second set of bearings 164 from the shaft 108. This release of the bearings 116 and 164 is also accomplished in a similar manner in an alternative embodiment where the bushing/release sleeve 114 is formed as an extension of the collar 112, such that the collar 112 and the release sleeve/bushing 114 are a single part. A positioning ring 312 is disposed concentrically within the sleeve 118 and around the socket 112 between the wave spring 310 and the bearings 164. The positioning ring 312 operates to engage and urge the bearings 164 into the socket 112 under the bias of the wave spring 310, until counteracted by the pressing of the collar 122 into engagement with the bushing 114, as described previously.

When a shaft 108 of a suitable implement is to be engaged with the handle 100 utilizing the mechanism 106, as best illustrated in FIGS. 4-5 and 11-13, the first portion 200 of the shaft 108 is inserted within the socket 112 and received within aligned grooves 130 in the socket 112 to engage the shaft 108 with the handle 100. The insertion of the shaft 108 into the grooves 130 is facilitated by the tapered ends 132 of the grooves 130. When positioned within the grooves 130, the end 202 of the shaft 108 is maintained in alignment with the handle 100 by the engagement of the grooves 130 and bearings 116 around the periphery of the first portion 200.

Figure 4:
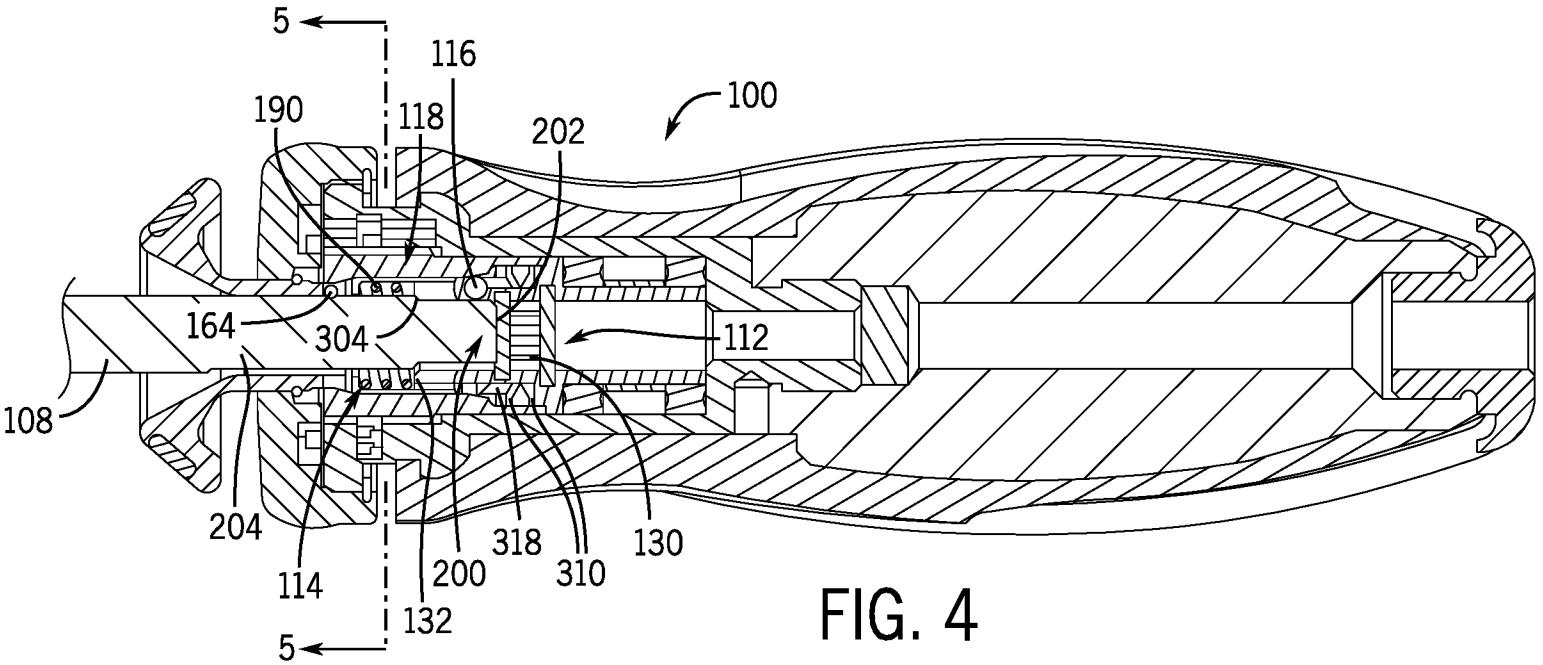
FIG. 4 is a cross-sectional view similar to FIG. 3 showing a shaft engaged with the securing mechanism.

To lock the shaft 108 within the handle 100 during use, initially the release collar 122 is urged inwardly into the passage 144 against the bias of the biasing member 190. In doing so, the ring 156 moves within the recess 158 until reaching the inner end of the recess 158, thereby halting further movement of the collar 122. In this position, when the end 202 of the shaft 108 is inserted into the passage 151 in the collar 122, the end 202 can contact the hearings 164 and urge the bearings 164 out of the guide portion 150 of the collar 122, such that the end 202 can pass through the collar 122 and into the locking sleeve 118, bushing 114 and socket 112, as shown in FIG. 4. By rotating the shaft 108 as necessary, the end 202 can contact the tapered ends 132 to be aligned with, seated within and engaged by the grooves 130 and bearings 116 of the socket 112, as described previously.

After the end 202 and first portion 200 are properly seated within the grooves 130 in the socket 112, the release collar 122 is released, such that the biasing member 190 urges the collar 122 outwardly from the locking sleeve 118 and the bushing 114 relative to the socket 112. In doing so, the apertures 162 and bearings 164 on the guide portion 150 of the collar 122 are moved into the inwardly tapering section of the locking collar 118, where the bearings 164 are urged inwardly into the passage 151 defined within the release collar 122 by the locking collar 118. However, since the shaft 108 is now positioned within the passage 151, certain bearings 164 frictionally engage the faces 306 of the second portion 204 of the shaft 108, thereby providing a secure engagement of the shaft 108 within the mechanism 106. The particular bearings 164 engaging the second portion 204 will depend on the orientation of the shaft 108 within the socket 112 and the particular cross-sectional shape of the second portion 204 and position of the associated faces 306 on the second portion 204, hut the number and position of the bearings 164 within the passage 151 provides a universal and secure engagement between the bearings 164 and a second portion 204 of varying configurations and/or shapes, thereby preventing the removal of the shaft 108 from within the collar 122, so that the shaft 108 can be utilized in conjunction with the handle 100 as desired.

In addition, in this position, the shaft 108 is engaged with each of the bearings 164 in the collar 122 and the grooves 130 and hearings 116 in the socket 112, resulting in two separate and spaced apart axial alignment contacts between the shaft 108 and the handle 100. With this structure for the mechanism 106, the force exerted through the handle 100 onto the shaft 108 does not alter the alignment of the shaft 108 with respect to the handle 100, i.e., greatly reduces the amount of axial misalignment or "slop", even after repeated uses, due to the engagement of the shaft 108 by both the grooves 130 and the bearings 116, as well as the hearings 164 while greatly increasing the concentricity of the shaft 108 with respect to the mechanism 106 and handle 100.

To remove the shaft 108, the collar 122 is again pressed into the locking collar 118 against the bias of the biasing member 190, which allows the bearings 116 and 164 to be disengaged from the shaft 108, and the shaft 108 can be removed from the collar 122, locking sleeve 118 and socket 112.

Thus, the mechanism 106 securely engages the shaft 108 having any configuration for the second portion 204 via the bearings 116 and 164, while simultaneously maintaining the alignment of the shaft 108 with the mechanism 106 and handle 100 via the hearings 164 as well as the bearings 116 and grooves 130.

Certain improvements provided by the securing mechanism 106 of the present disclosure include, but are not limited to:

1. Elimination of toggle by locking at two areas tapers 300, 302 spaced further apart and the one piece construction of the sleeve 118 that holds both sets of the locking bearings 116,164 spaced apart along tapers 300, 302.
2. Hold device/shaft/implement 108 concentric with handle 100, because both locking tapers 300, 302 reside on the same part, i.e., the sleeve 118. Concentric force by lock balls.
3. Grip strength increased by point to line contact between lock bearings 164 and internal square to driven shaft 108. Location of bearings 164 on points of double square allow ease of ¼" drive square installation, shaft 108 can be rotated 45 degrees and re-inserted. Bearings 164 will lock in either position. Increased pull out force twists shaft against internal geometry of groove 130 and socket 112.
4. This securing mechanism design can be used with other shaft geometries—AO, Tri-Flat, ¼" Square, Hudson, Stryker, and many other standard shaft quick connect geometry.
5. Bearing 116 design allows for concentric contact on shafts 108 with flat faces 304, 306 on shaft portions 200, 204, which can be of different diameters. Always provides contact on the circumference.

Various other embodiments of the present invention are contemplated as being within the scope of the following claims particularly pointing out and distinctly claiming the subject matter regarded as the invention.

The invention claimed is:

1. A securing mechanism for attaching the shaft of an implement to a tool, the mechanism comprising:

a) a socket adapted to be secured to the tool, the socket including at least two grooves disposed on an interior surface of the socket and engageable with the shaft to maintain the alignment of the shaft with the mechanism;

b) a locking sleeve including a central passage aligned with the socket and having a first taper and a second taper therein;

c) a release collar aligned and inserted within the passage of the locking sleeve, the collar including a first bearing selectively engageable with the first taper and adapted to engage the shaft;

d) a second bearing disposed within at least one opening in the socket positioned between the at least two grooves, the second bearing selectively engageable with the second taper and adapted to engage the shaft;

e) a first biasing member disposed within the passage between the socket and the collar to bias the collar and the first bearing into engagement with the first taper;

f) a positioning ring disposed around the socket within the passage of the locking sleeve and engaged between a second biasing member and the second bearing, the positioning ring engageable with the second bearing to bias the second bearing into engagement with the second taper; and g) a bushing disposed within the passage of the locking sleeve and engaged between the first biasing member and the release collar, the bushing engageable with the second bearing such that the first and second bearings can be released with a single action.

2. The securing mechanism of claim 1 wherein the bushing and release collar are one component.

3. The securing mechanism of claim 1 wherein the first bearing and the second bearing are adapted to engage separate surfaces on the shaft.

4. The securing mechanism of claim 3 wherein the first bearing and the second bearing are adapted to engage surfaces having different cross-sections on the shaft.

5. The securing mechanism of claim 3 wherein the second bearing is adapted to engage a flat surface of the shaft in an off-center position.

6. The securing mechanism of claim 1 wherein the first bearing and the second bearing are adapted to engage different diameter surfaces of the shaft.

7. A tool comprising:

a) a handle; and b) the mechanism of claim 1 disposed in the handle.

8. A method for attaching a shaft of an implement to a tool using the mechanism of claim 1.

9. A tool comprising:

a) a handle including a cavity formed therein; and b) a securing mechanism disposed within the cavity, the securing mechanism comprising:

i) a socket adapted to be secured to the tool, the socket including at least two grooves disposed on an interior surface of the socket and engageable with a shaft to maintain the alignment of the shaft with the mechanism;

ii) a locking sleeve including a central passage aligned with the socket and having a first taper and a second taper therein;

iii) a release collar aligned and inserted within the passage of the locking sleeve opposite the socket, the collar including a first bearing selectively engageable with the first taper and adapted to engage the shaft;

iii) a second bearing disposed within at least one opening in the socket positioned between the at least two grooves, the second bearing selectively engageable with the second taper and adapted to engage the shaft;

iv) a first biasing member disposed within the passage between the socket and the collar to bias the first bearing into engagement with the first taper;

v) a second biasing member disposed within the passage to bias the second bearing into engagement with the second taper; and vi) a bushing disposed within the passage of the locking sleeve and engaged between the first biasing member and the release collar and extending around the first biasing member, the bushing engageable with the second bearing such that the first and second bearings can be released with a single action; and vii) a positioning ring disposed within the passage of the locking sleeve and engaged between the second biasing member and the second bearing.

10. The tool of claim 9 wherein the second bearing is adapted to engage a shaft in an off-center position.

11. The tool of claim 9 further comprising a shaft engageable with the securing mechanism, the shaft including a first portion adjacent and end of the shaft, the first portion having a first cross-sectional shape and a number of first flat surfaces thereon.

12. The tool of claim 11 further comprising a second portion on the shaft adjacent the first portion and having a second cross-sectional shape and a number of second flat surfaces thereon.

13. The tool of claim 12 wherein the first cross-sectional shape is different than the second cross-sectional shape.

14. The tool of claim 13 wherein first cross-sectional shape has a different diameter than the second cross-sectional shape.

* * * * *